United States Patent [19]

Haavik

[11] 4,172,694

[45] Oct. 30, 1979

[54] LONG LIQUID RING PUMPS AND COMPRESSORS

[75] Inventor: Harold K. Haavik, South Norwalk, Conn.

[73] Assignee: The Nash Engineering Company, Norwalk, Conn.

[21] Appl. No.: 849,298

[22] Filed: Nov. 7, 1977

[51] Int. Cl.[2] ..... F04C 19/00

[52] U.S. Cl. ..... 417/68

[58] Field of Search ..... 417/68, 69

[56] References Cited

U.S. PATENT DOCUMENTS

| | | | |
|---|---|---|---|
| 2,928,585 | 3/1960 | Keef et al. | 417/68 |
| 3,228,587 | 1/1966 | Segebrecht | 417/68 |
| 3,232,521 | 2/1966 | Deardorff et al. | 417/68 |

FOREIGN PATENT DOCUMENTS

| | | | |
|---|---|---|---|
| 1047981 | 12/1958 | Fed. Rep. of Germany | 417/68 |
| 1057284 | 5/1959 | Fed. Rep. of Germany | 417/68 |
| 529295 | 9/1976 | U.S.S.R. | 417/68 |

*Primary Examiner*—Carlton R. Croyle
*Assistant Examiner*—Edward Look
*Attorney, Agent, or Firm*—A. C. Nolte, Jr.; Edward B. Hunter

[57] ABSTRACT

A liquid ring vacuum pump or compressor in which the port members open to the buckets of the rotor intermediate to the ends of the rotor so that the ratio of the axial length of the pump to the diameter can be relatively high.

16 Claims, 11 Drawing Figures

FIG. 4
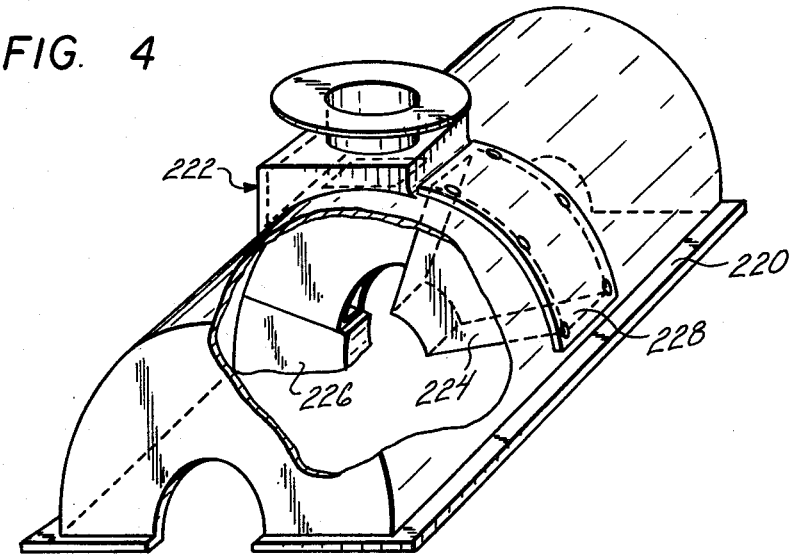
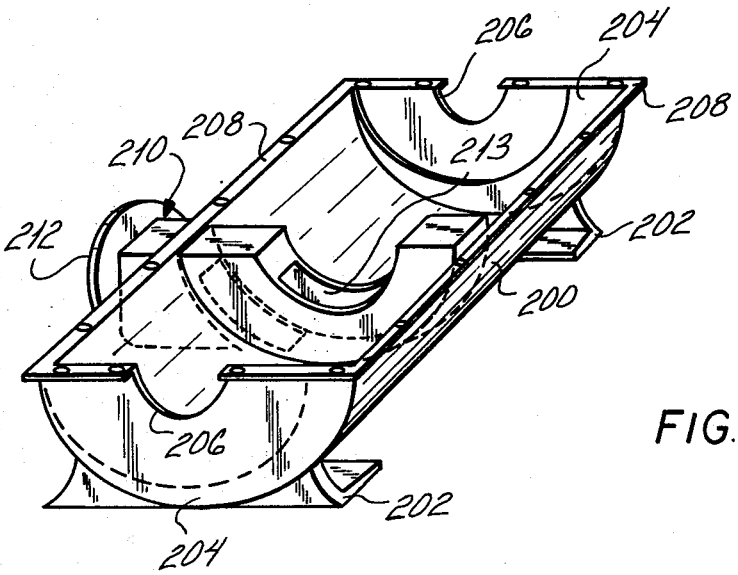
FIG. 3

LONG LIQUID RING PUMPS AND COMPRESSORS

BACKGROUND OF THE INVENTION

This invention is concerned with liquid ring vacuum pumps and compressors (hereinafter for the sake of brevity referred to simply as liquid ring pumps). The conventional liquid ring pump comprises a rotor having a plurality of longitudinally extending, generally radially disposed vanes which define working chambers or buckets. The rotor is disposed within an eccentric casing and a liquid seal, introduced into the casing, is caused by centrifugal force produced by the rotor, to form a ring following the casing. Since the casing is eccentric, the liquid of the ring alternately advances towards and recedes from the rotor axis to produce a pumping action within the buckets.

The casing may either define a single lobe, in which case its inner wall is generally circular and is centered on an axis offset from that about which the rotor turns so that there would be one pumping cycle per revolution of the rotor or the casing may define plural lobes (generally two lobes) in which case there are as many pumping cycles per revolution of the rotor as there are lobes. A typical single lobe pump is that described in U.S. Pat. No. 3,154,240 issued Oct. 27, 1964. A typical multiple lobe pump is shown in the U.S. Pat. No. 3,588,283 issued June 28, 1971.

Conventionally, pumps of the above types are constructed according to either a center port design or a side port design. In the center port design the port member is disposed within a cylindrically or conically shaped cavity within the rotor and has passages terminating in ports with which the open, radially inner ends of the rotor buckets are sequentially brought into register as the rotor turns. In the side port design, the port member is a radially disposed plate; the axial ends of the rotor buckets are at least partially open to and are brought sequentially into register with the openings on the port member corresponding to the intake and discharge regions of the pumping cycle. Pumps have also been constructed with a combination of these two arrangements with one of the inlet and outlet ports being in a radially disposed port member and the other being disposed in a central port member.

A feature common to all of these types of pumps is the disposition of a head leading to the ports at the longitudinal ends of the casing.

The parameters which largely determine the capacities of these pumps are the diameter and length of the rotor, which largely determine the rotor bucket volumes and the speed at which the rotor is turned. The operating tip speed of the rotor is limited by reason of performance and wear considerations to approximately 90 fps where the tip speed is defined as the tangential velocity of the rotor measured at its outer diameter. Generally, the 40 fps tip speed is a minimum below which the pump does not have a useful compression ratio. Above 50 fps the performance of the pump, reported as the horsepower required to pump a given volume of gas (reported as HP/CFM) generally deteriorates, i.e. the HP/CFM increases, in proportion to the square of the tip speed.

Because of the tip speed limitations, the RPM over which a pump may be operated efficiently is inversely proportional to its diameter. That is, a larger diameter pump must be run at a slower RPM to keep its tip speed in a commercially feasible range. However, since slower RPM motor drives are generally more expensive or involve expensive speed reduction equipment, it often is more attractive to gain capacity by increasing the pump length rather than by increasing its diameter.

It is also apparent that increased pump capacity gained by extending length as opposed to increasing diameter is desirable in those cases where the manufacturing operations have diametrical size limitations.

Prior to this invention, however, there has existed a restrictive limit to the length that a liquid ring pump of given rotor diameter could be constructed. This limit has been established by:

1. Aerodynamic considerations of the gas flow through the head and into and out of the rotor buckets; an excessive length to diameter ratio causes excessive pressure drop on the intake side, thus reducing volumetric efficiency.

2. Hydraulic considerations of the liquid ring; it is known that conventional liquid ring pumps are subject to hydraulic instability of the liquid ring when their length to diameter ratio is excessive. The instability manifests itself by the presence of noise and unusual wear, due to cavitation, the net effect of which is to make the product commercially unsuitable.

3. The strength of the shaft; it will be recognized that increasing the shaft diameter, to render it more resistant to bending, necessarily diminishes the capacity of the pump.

The net effect of these considerations is that the practical limit of liquid ring pump designs of the current state of the art is a length to diameter ratio of approximately 0.75 for a one sided entry rotor, i.e. a pump having a head at only one end of the rotor or 1.50 for a two sided entry rotor, i.e. a pump having a head at each axial end of the rotor.

In consequence of this, higher volume liquid ring pumps have necessarily been of limited length and have required large diameter rotors and the resulting lower speed drives. As pointed out, all of these factors lead to high manufacturing and motor drive costs.

SUMMARY OF THE INVENTION

According to the present invention there is provided a liquid ring pump of which the port members are disposed intermediate to the axial ends of the rotor so that the gas to be pumped is admitted to the regions of the rotor buckets to both sides of the port member.

It will be appreciated that while with conventional pumps the incoming gas entering the buckets through a head at the end of the rotor must travel from the head to the opposite end of the bucket to fill that bucket, this is not the case with the present invention. With the port members disposed intermediate to the ends of the rotor it is possible to fill the buckets of a long rotor during the limited time available over the suction stroke, for that purpose.

Specifically, according to this invention the rotor blades are notched, intermediate to their ends, from their radially outer edges to the rotor hub so there is defined by those notches an annular gap. Port members secured to the casing project inward radially from the casing towards the rotor hub into that gap.

The numerous advantages to be had by the adoption of the present invention will become apparent from the following description.

DESCRIPTION OF THE FIGURES OF THE DRAWINGS

Embodiments of the present invention are illustrated schematically in the accompanying drawings in which;

FIG. 3 is a perspective illustration of a part of another embodiment of the present invention;

FIG. 4 is a perspective view, partly cut away of another part of the embodiment of the invention illustrated in FIG. 3;

DESCRIPTION OF THE PREFERRED EMBODIMENTS OF THE PRESENT INVENTION

Figure 1:
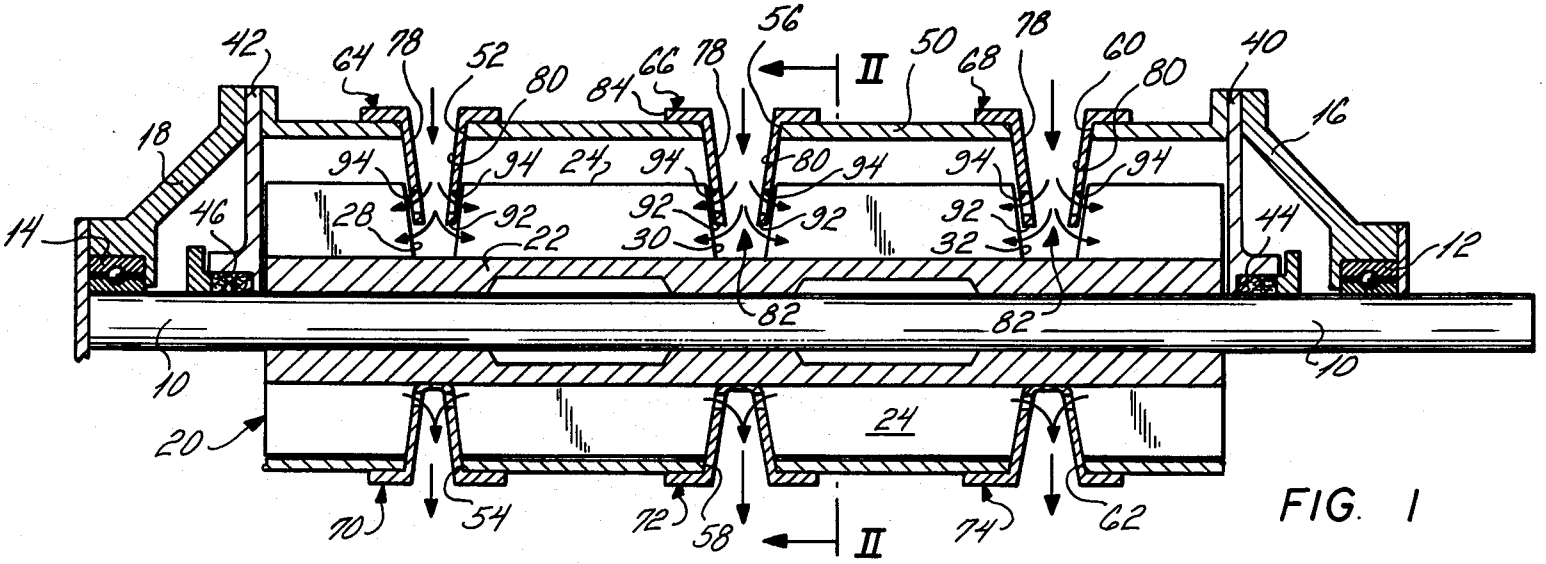
FIG. 1 is a cross-section of a pump according to this invention taken on the line 1—1 of FIG. 2.
Figure 2:
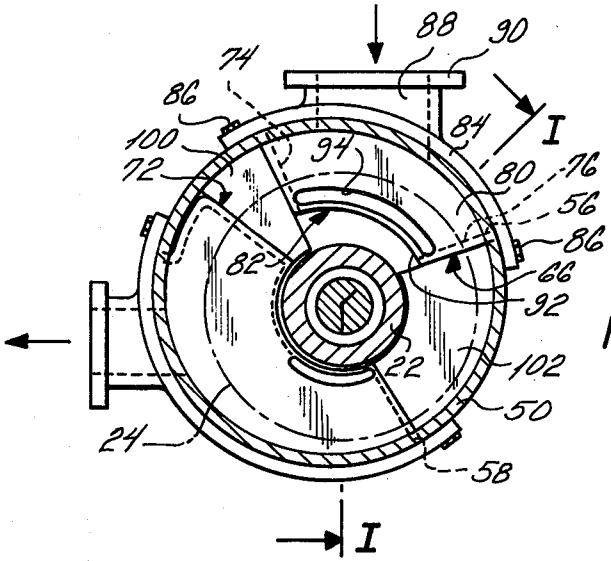
FIG. 2 is a cross-section of the line 2—2 of FIG. 1.

The pump of FIGS. 1 and 2 comprises a rotor drive shaft 10 supported in bearings 12 and 14 in pedestal means 16 and 18, which in the interest of clarity are broken away. The end of shaft 10 adjacent bearing 12 is connected to a motor drive in conventional manner.

The rotor 20, comprising a hub 22 and blades 24 which are generally longitudinally extending and radially disposed is attached to the shaft in a conventional manner. It must be recognized that while the blades are identified as being longitudinally extending and radially disposed, these are relative terms. The blades need not necessarily be of flat plate form and may be curved and they may be skewed relative to the axis of the rotor to a limited extent, for the purposes of, for example, noise suppression or for hydro-dynamic considerations.

Each of the blades is notched as at 28, 30 and 32. The notches of the blades are aligned so that they define an annular gap in the rotor. It will be noted that the notches extend from the radially outer edges of the blades to the hub of the rotor.

It should be noted here that while the particular construction shown in FIG. 1 involves one rotor structure in which the annular notches have been cut away, the invention is by no means limited in this respect. Another feasible method of construction would utilize a series of rotors with spacer rings mounted on the shaft, the spacer rings separating the rotors to define the same basic geometry as FIG. 1 as described infra and with reference to FIG. 9.

Supported by the pedestal elements 16 and 18 are casing end walls 40 and 42 respectively, those end walls having shaft seals or stuffing boxes at 44 and 46, respectively, which seal the casing against the egress of seal liquid and gas along the shaft.

Mounted to the end walls 40 and 42, and of course to the pedestals 16 and 18, is a cylindrical casing 50. It may be recognized that while in this embodiment the casing is illustrated as being cylindrical any other efficient shape may be utilized, for example, for a two lobed pump, the casing would have a generally elliptical cross-section. In a region of the casing registering with the annular gap of the rotor defined by notches 28 are a pair of circumferentially spaced openings 52 and 54 which, in development, are of substantially rectangular form. Similarly, there are openings 56 and 58 at the gap defined by notches 30 and openings 60 and 62 at the gap defined by notches 32.

Of these openings 52, 56 and 60 are for the reception of inlet or suction port members 64, 66 and 68, respectively, while openings 54, 58 and 62 are for the reception of port members 70, 72 and 74, respectively, those port members being outlet or discharge port members.

The port members at the gap 30 of the rotor can be seen in FIG. 2 and these have the same form as the port members at gaps 28 and 32. For this reason, only port members 66 and 72 are described in detail herein.

Inlet port member 66 comprises a generally arcuate body defined by opposite radial walls 74 and 76 and transversely disposed walls 78 and 80 (see FIG. 1). Walls 78 and 80 are disposed to converge toward one another towards the rotor hub, the inclination of those walls being the same as the edges of the blades at the notched regions. The bottom of the port member is open as at 82.

The radially outer edges of the port member are provided with a flange 84 shapedtto conform to the outer surface of the casing. By means of this flange and appropriate bolts or screws, the port member is secured in position on the casing as indicated at 86. Projecting from the outer side of the port member is an inlet duct 88 with a flange 90 for connection to appropriate piping.

The innermost edges 92 of the inlet or suction port are spaced from hub 22 and adjacent those edges 92 are arcuate port openings 94 which are disposed radially inwardly of the inner surface of the ring liquid.

As it will be discerned from FIG. 2, discharge port 72 is of generally similar structure to inlet or suction port 74 except as hereinafter described.

Figure 11:
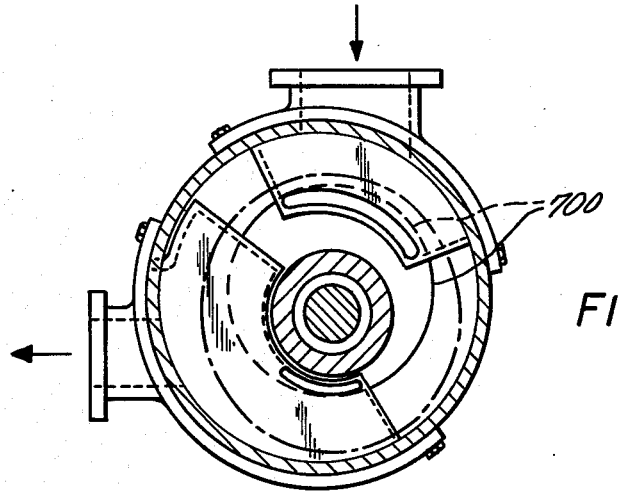
FIG. 11 is a cross-sectional view of another pump according to the present invention.

Between adjacent radial walls of the port members are disposed blocks 100, 102 which extend from the casing wall to the hub of the rotor and fill the space between the port members and the adjacent edges of the notches of blades 24 of the rotor. To assemble the port members and blocks, first one of the ports is placed in position then the blocks are placed in position through the opening for the other port member and therefore the other port member is bolted into position. The blocks 100, 102 are effective to streamline the liquid ring but it will be appreciated that they are not strictly necessary and a pump without those blocks and in which the spaces between the inlet and outlet port members would be filled with seal liquid could successfully be operated. Such a pump is illustrated schematically in FIG. 11 which is a cross-sectional view similar to FIG. 2 and in which the inner face of the ring is shown at 700.

As noted hereabove, the general shape and structure of the inlet and discharge ports is similar. However, there are significant differences. The most apparent difference of course is that the discharge port member extends right up to the hub of the rotor with relatively close clearance between the inner surface and the rotor hub, while surface 92 of the inlet port is spaced considerably from the hub. Additionally, although not apparent from the drawings, the walls 78 and 80 of the inlet port are designed to have relatively high clearance with the adjacent edges of the rotor blades defining the notches. On the other hand, the corresponding walls of the discharge member are arranged to have close clearance with the edges of the blades.

In order to understand the significance of the ability to set the clearances individually it is useful to examine the circumferential pressure distribution of, for instance, a single lobe pump (one pumping cycle per revolution). The starting point of the cycle is defined as zero (0) degrees and is the land or the point at which the rotor is closest to the casing. Going in the direction of rotation, the first 180° defines the intake stroke during which the liquid ring is receding from the rotor buckets and they are drawing in the gas. From 20° to 180° gas is essentially at the suction pressure and bucket to bucket leakage within this region is minimal and of no significance. Therefore, this region can operate with a large running clearance with no consequent performance loss. From 180° to approximately 220° to 280° (depending upon the design compression ratio of the pump) the compression stroke is defined. Within this segment all of the compressive work on the gas is performed. Here a close clearance is required since the gas pressure increases from the suction pressure at 180° to the discharge pressure at the start of the discharge port. The discharge stroke, i.e. the region over which the buckets are open to the discharge or outlet port, extends from wherever the compression stroke ends to a point slightly ahead of the land, typically at around 340°–350°. The discharge stroke is essentially constant pressure region and, as is the case with the intake stroke, does not require close clearances. Finally the transition from discharge to intake, i.e. from 340°–350° through the land to approximately 10°–20° past the land, requires a close clearance since it is sealing across the full operating compression ratio of the pump.

By arranging that the inlet port has substantial clearance between wall 92 and the hub of the rotor and buckets of the rotor are able to breathe over the full extent of the intake stroke rather than, as in conventional pumps, to breathe only over the extent of the port opening. Also by providing the substantial clearance between walls 78 and 80 of the inlet port and the adjacent edges of the rotor blades the danger of rubbing is eliminated. This is significant since, of course, deflection of the rotor under the hydraulic forces generated during operation of the pump is mainly towards the intake (lower pressure) side of the pump.

The close clearances between the discharge port member and the edges of the rotor blades is, of course, necessary to avoid leakage of the gas from one bucket to the next. Note that the discharge port member shown in this embodiment extends over the compression and discharge sectors, i.e. from approximately 180° through 350°. As explained above, the close clearance in the port member is only required in the compression sector but in this case is carried over into the discharge sector merely as a result of both sectors being constructed from one piece. By the adoption of the wedge shape of the port member and the corresponding shape of the notches in the blades, it is a simple matter to adjust this close clearance simply by the insertion of shims between the flanges of the port member and the casing.

Also by virtue of the "wedge shape" of the port member the effect of radial deflection of the rotor away from the outlet port, resulting from the hydraulic forces generated during operation, is minimized. For example, the embodiment of the invention illustrated in FIGS. 1 and 2 has an included angle of 16 degrees between the sides of the port members which means that for a radial deflection of the shaft of 0.010 inches, an increase in the axial clearance between the sides of the outlet port member and the edges of the rotor blades of only 0.0014 inches would occur.

FIGS. 3 and 4 show, schematically, an embodiment of the invention in which the casing is of split construction. The casing is split along a horizontal central plane and the lower half of the casing is illustrated in FIG. 3. The lower half of the casing comprises a semi-cylindrical body 200 having supporting pedestal means 202 at opposite ends and opposed end walls 204 which have semi-circular recesses 206 which receive the stuffing boxes and the shaft about which those stuffing boxes are disposed. Extending around the edges of the body 200 and the upper edges of the end walls 204, is a flange 208 which, as will become apparent from the following description, serves to connect the lower half of the casing to the upper half.

Fixed within the lower half of the casing is an inlet port member indicated generally at 210 which has a flanged connection 212 to appropriate pipe work and an inlet port 212 leading to the buckets. As in the arrangement of FIGS. 1 and 2 inlet port 212 is disposed radially inwardly of the surface of the liquid ring but spaced outwardly of the hub of the rotor.

The upper half of the casing, illustrated in FIG. 4, comprises a flange 220 for cooperation with flange 208 of the lower half of the casing. Fixedly secured to the casing as, for example, by welding is a discharge port 222 and immediately adjacent the sides of the discharge port are blocks 224 and 226, block 224 having a flange 228 by which it is connected to the casing body, the blocking portion of block 224 projecting through an appropriate rectangular section opening in the casing body. Similarly, block 226 has a flange, not visible in the drawings, by which it is connected to the casing.

The utilization of these flanges allows the position of the blocks to be adjusted radially by the insertion of shims between the flanges and the casing body so that effective seals between the edges of the rotor blades and the side surfaces of the blocks can be obtained. Additionally, the radially inner edges of the blocks are provided with appropriate seals as, for example, a low friction wiper type in sliding contact with the rotor hub.

It will be apparent that the adjustment of the block 224 is effective to provide a seal against leakage of the pumped gas from one bucket to the next following bucket in the compression zone while the block 226 is effective to prevent leakage of gas from the discharge zone to the inlet or intake zone.

Figure 5:
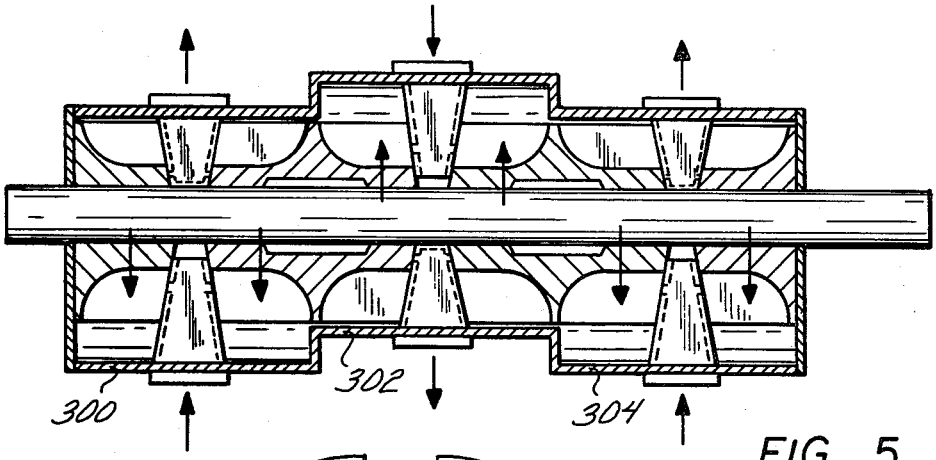
FIG. 5 is an axial cross-section of another embodiment of the present invention.
Figure 6:
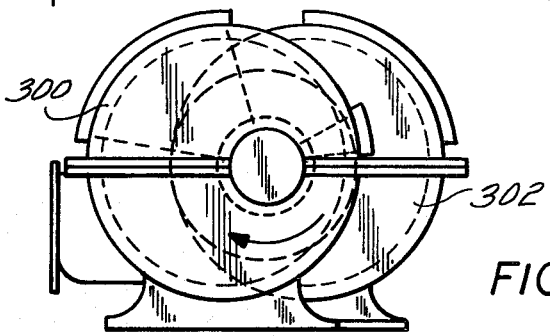
FIG. 6 is an end view of the embodiment of FIG. 5.

FIGS. 5 and 6 illustrate an alternative form of pump according to the present invention, in which the casing is made up of three sections 300, 302 and 304. Casing sections 300 and 304 are coaxial and casing section 302 is displaced from sections 300, 304. The arrangement is such that the lands of those sections i.e. those regions of the casings which are most closely approached by the rotor, are angularly coincident in sections 300 and 304 and the land of section 302 is shifted 180° from the lands of sections 300 and 304. Otherwise, the casings and their relationship to the port members and the port members relationship to the rotor blades is as described with reference to FIGS. 1 and 2. By the adoption of this offset, the out-of-balance hydro-dynamic forces generated in sections 300 and 304 tend to be balanced by the corresponding forces in section 302.

Figure 7:
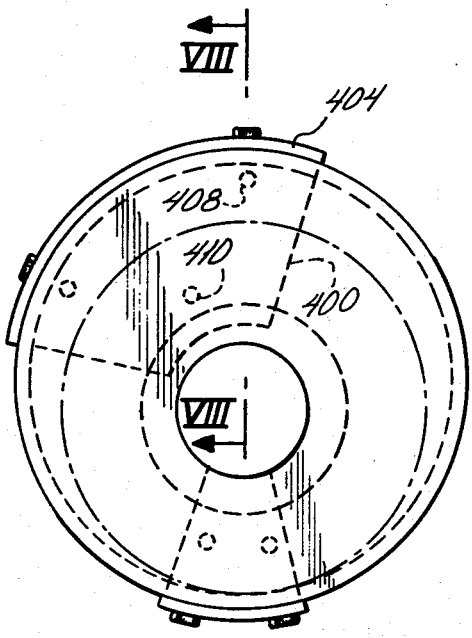
FIG. 7 is a schematic end-view of another embodiment of the present invention.
Figure 8:
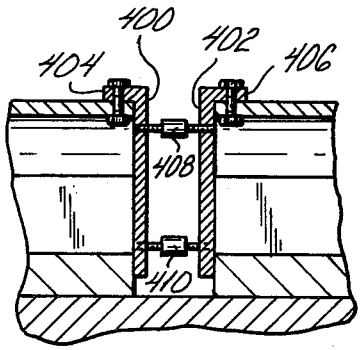
FIG. 8 is a detail of the embodiment of FIG. 7.

A further embodiment of the invention is illustrated in FIGS. 7 and 8, that embodiment in certain respect resembling the embodiment of FIGS. 3 and 4 except that the casing is not split. However, the port members are fixed and the blocking members serve to provide effective seals between the individual buckets in the compression region of the pump and between the discharge port and the inlet port.

In this embodiment, the notches of rotor blades have straight sides unlike the embodiment of FIGS. 1 and 2 and that of FIGS. 3 and 4. To provide adjustment of the blocks, they are formed of a pair of plates 400 and 402, those plates having flanges 404 and 406 by which they may be bolted to the casing. To provide adjustment of the clearances between the plate 402 and 400 and the adjacent edges of the rotor blades, turnbuckle type elements 408 and 410 are provided to inter-connect the plates, adjustment of those turnbuckle elements serving to adjust the spacing between the plates and, of course, in so doing, between the plates and the edges of the rotor blades. Appropriately, the turnbuckles have locking elements to fix their position.

The inner peripheral edges of the plates have appropriate seals to cooperate with the hub of the rotor and the operation of the device other than as above described is substantially similar to that of the other embodiments of the present invention.

Figure 9:
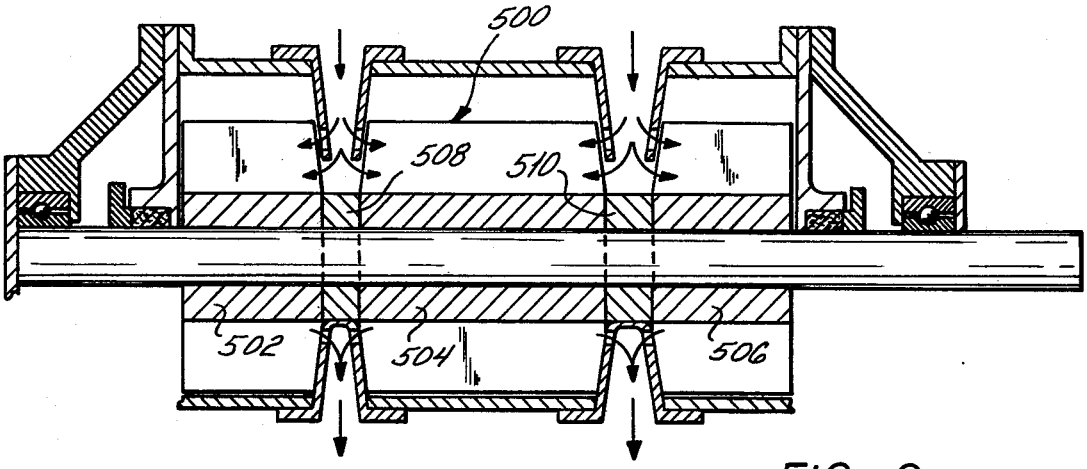
FIG. 9 is a cross-sectional view of a further embodiment of the invention.

The embodiment of the invention in FIG. 9 is substantially similar to that in FIG. 1 except that the rotor 500 is formed of separate bladed sections 502, 504 and 506 the positions of which are fixed by spacers 508 and 510 mounted on the shaft.

Figure 10:
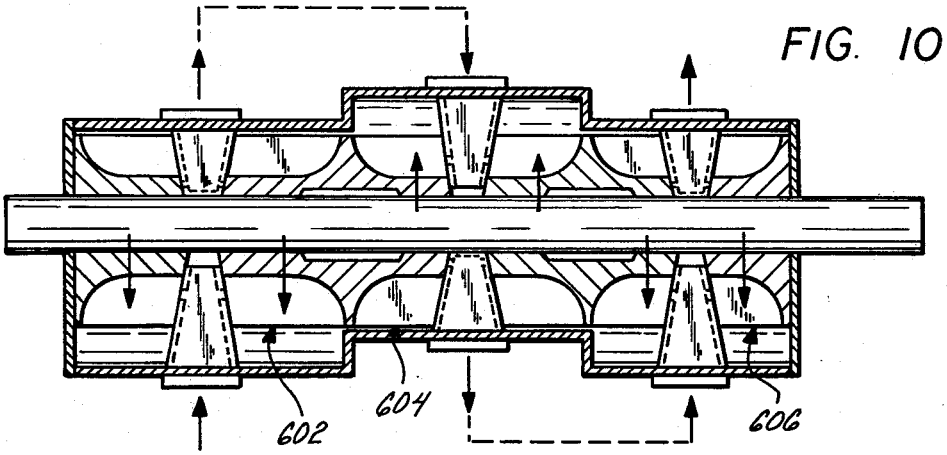
FIG. 10 is a cross-sectional view of yet another embodiment of the invention.

Another embodiment of the invention is illustrated in FIG. 10 which comprises a structure largely similar to that of FIG. 5 but one in which rotor section 602 is of greater axial length than rotor section 604 and rotor section 604 is of greater length than section 606. The port members are connected by appropriate pipe work as indicated in chain-line to achieve multistage or multiplex pumping.

With the adoption of the present invention numerous substantial advantages arise. The primary advantage results from removing the gas delivery systems from the ends of the rotor, as is conventional in the so-called center port and side port pumps, to a region intermediate to the ends of the rotor and by providing several delivery points spaced along the length of the rotor. In this was the overall pump length is limited only by the mechanical strength of the rotor and shaft combination and not, as in the current designs, by a combination of the aerodynamic, hydraulic and shaft strength limitations described supra. This is primarily because the gas velocity and pressure drop through the port passages may be minimized simply by proper selection and design of the number of ports along the length of the shaft. For the same reason, the hydraulic problems associated with high length to diameter ratios are easily averted. Furthermore, because of the disposition of the ports it is clear that they are totally eliminated as a design restraint on the shaft diameter; whereas with conventional designs, especially of the center port type, the shaft diameter is critically limited since it must fit within the inner dimension of the center port piece.

The net result of the removal of the aforementioned restraints on the length is that it is possible to construct a liquid ring pump with an overall length to diameter ratio of more than 3.0, in other words, at least 100% over the current limit of conventional design liquid ring pumps.

Another advantage to be had from the present invention is the elimination of the complicated head castings from one or both ends of the pump of conventional design. Since the shaft bearings are invariably disposed outside of the head castings, the bearing span of a conventional pump is large. By the elimination of these complex space-consuming castings, the bearing span according to the present invention can be reduced.

Another advantage is the fact that the present invention allows the inlet and discharge port clearances to be set individually. With the existing arrangements, the clearances between, in a side-port pump, the end edges of the rotor blades and the control plates and in a center port pump, between the radially inner edges of the rotor blades and the center port, must be made the same in both the compression and suction zones. Since a close clearance is required only in the compression zone and in the zone between the discharge and intake ports to preclude leakage of the gases from bucket to bucket whereas a large clearance is preferred in the suction or inlet region, to accommodate deflections of the shaft carrying the rotor, the actual clearance adopted has been a compromise between the two conflicting needs. Since according to the present invention, the clearances in the compression zones and inlet zones can be individually set, it is possible to accommodate both requirements.

Furthermore, it is clear that in addition to the circumferential flexibility of clearance adjustment as noted above, there is also the ability to set clearances of the ports individually along the axial span of the rotor. This is important especially with long pumps where the rotor and shaft may sag appreciably from the static loading. Despite the sagging of the rotor, each port could be set to essentially the same running clearance.

Also, according to the present invention, one eliminates the complicated castings of current designs. In a center port pump, the head is of particular complex design and, of course, by the adoption of the individual ports according to this invention this casting problem is substantially eliminated. Additionally, the center ports themselves of the center port type pumps are quite complex requiring involved casting and machining techniques. The difficulty would also be eliminated.

Yet another advantage is the fact that the present invention makes possible the complete elimination of the shaft and the replacement of that shaft with an integral rotor-shaft casting or a rotor casting to which shaft stubs are attached at either end.

Also as noted hereabove the present invention allows, by virtue of eliminating the aerodynamic and hydraulic limitations, the production of a longer, and less expensive, pump than with conventional designs and one which is without performance penalties.

What is claimed is:

1. A liquid ring pump comprising a rotor, having a plurality of generally axially extending blades, a casing, an inlet port member structure and a separate outlet port member structure, said port member structures being separately secured to said casing at circumferentially spaced locations intermediate to the axial ends of the blades of the rotor and projecting inwardly of the casing into an annular gap in the rotor defined by notches in said blades.

2. A liquid ring pump as claimed in claim 1 wherein each blade has at least two spaced notches intermediate to its longitudinal ends, said notches defining two or more longitudinally spaced annular gaps in the rotor, and port member structures extending into each gap.

3. A liquid ring pump as claimed in claim 1 comprising at least two inlet port member structures and a like number of outlet port member structures one inlet port member structure and one outlet port member structure being circumferentially spaced and disposed at one location intermediate to the ends of the rotor and the other inlet and outlet port member structures being circumferentially spaced and disposed at locations intermediate to the ends of the rotor and longitudinally spaced from said one location.

4. A liquid ring pump as claimed in claim 1 wherein said outlet port member has surfaces defining a close running clearance with edges of said blades defining said annular gap and said inlet port members having surfaces defining relatively large clearances between the edges of said blades defining said annular gap.

5. A liquid ring pump as claimed in claim 4 wherein the edges of said blades defining said annular gap are inclined towards each other, the closest portions of the edges being nearest to the rotor axis.

6. A liquid ring pump as claimed in claim 5 wherein the location of said port members is adjustable radially of the rotor.

7. A liquid ring pump as claimed in claim 6 wherein said port member structures comprise a port body including ports, said port body extending through an opening formed in said casing, said port body having flanges by which said port member structure is secured to said casing, adjustment of said port member structures being effected by the insertion and removal of shim means between said flange and said casing.

8. A liquid ring pump as claimed in claim 4 wherein the clearance between said surface of said port members and the edges of the blades is adjustable.

9. A liquid ring pump as claimed in claim 1 wherein the location of said port members is adjustable radially of the rotor.

10. A liquid ring pump as claimed in claim 1 wherein adjacent, generally radially extending surfaces of said port members are circumferentially spaced, the spaces between said port members being filled by blocking members.

11. A liquid ring pump as claimed in claim 10 wherein said blocking means extend radially inwardly towards a hub of said rotor, the inner edges of said blocking means constituting seal means cooperating with said rotor hub.

12. A liquid ring pump as claimed in claim 11 wherein the radial position of said blocking members is adjustable.

13. A liquid ring pump as claimed in claim 1 wherein each blade is notched completely to a hub portion of the rotor and wherein said port members comprise inlet and outlet port members, the inlet port member terminating at a location radially spaced from said hub of the rotor.

14. A liquid ring pump as claimed in claim 13 wherein said outlet port member extends radially inwardly to have close clearance with the hub of the rotor.

15. A liquid ring pump as claimed in claim 1 wherein said rotor is formed of at least two axially spaced separable blade sections, said port members being disposed at the adjacent ends of said section.

16. Liquid ring pumping apparatus comprising a first liquid ring pump having a rotor and a casing said rotor having a plurality of generally longitudinally extending and radially disposed blades, each blade being notched intermediate to its longitudinal ends to define an annular gap and port members secured to said casing and extending into said annular gap, said port structure members comprising an inlet port and separate outlet port structure, a second liquid ring pump of generally similar construction to said first liquid ring pump and of lesser capacity than said first pump, the outlet of said first pump being connected to the inlet of said second pump.

* * * * *